US011131093B2

(12) United States Patent
Toffoli

(10) Patent No.: US 11,131,093 B2
(45) Date of Patent: Sep. 28, 2021

(54) SYSTEMS, METHODS AND APPARATUS FOR INTERLOCKING UNITIZED CURTAINWALL BUILDING FAÇADE

(71) Applicant: BVGIazing Systems Ltd., Concord (CA)

(72) Inventor: Elio Toffoli, Concord (CA)

(73) Assignee: BVGlazing Systems Ltd., Ontario (CA)

( * ) Notice: Subject to any disclaimer, the term of this patent is extended or adjusted under 35 U.S.C. 154(b) by 0 days.

(21) Appl. No.: 16/705,335

(22) Filed: Dec. 6, 2019

(65) Prior Publication Data

US 2021/0172169 A1 Jun. 10, 2021

(51) Int. Cl.
*E04B 2/96* (2006.01)
*E04B 1/62* (2006.01)

(52) U.S. Cl.
CPC ..... *E04B 2/965* (2013.01); *E04B 2/967* (2013.01); *E04B 1/62* (2013.01)

(58) Field of Classification Search
CPC ..... E04B 2/965; E04B 2/967; E04B 1/62
See application file for complete search history.

(56) References Cited

U.S. PATENT DOCUMENTS 5,077,947 A * 1/1992 Takeda ..... E04B 2/94 52/235
5,158,392 A * 10/1992 Takeda ..... E04B 2/34 403/315
9,752,319 B1 * 9/2017 LeVan ..... E04B 2/885

* cited by examiner

*Primary Examiner* — Patrick J Maestri
(74) *Attorney, Agent, or Firm* — Mark D. Penner

(57) ABSTRACT

The present invention relates to the exterior building envelope systems. This invention particularly relates to a façade system supported by a continuous anchor secured to the slab without embedded attachments.

20 Claims, 9 Drawing Sheets

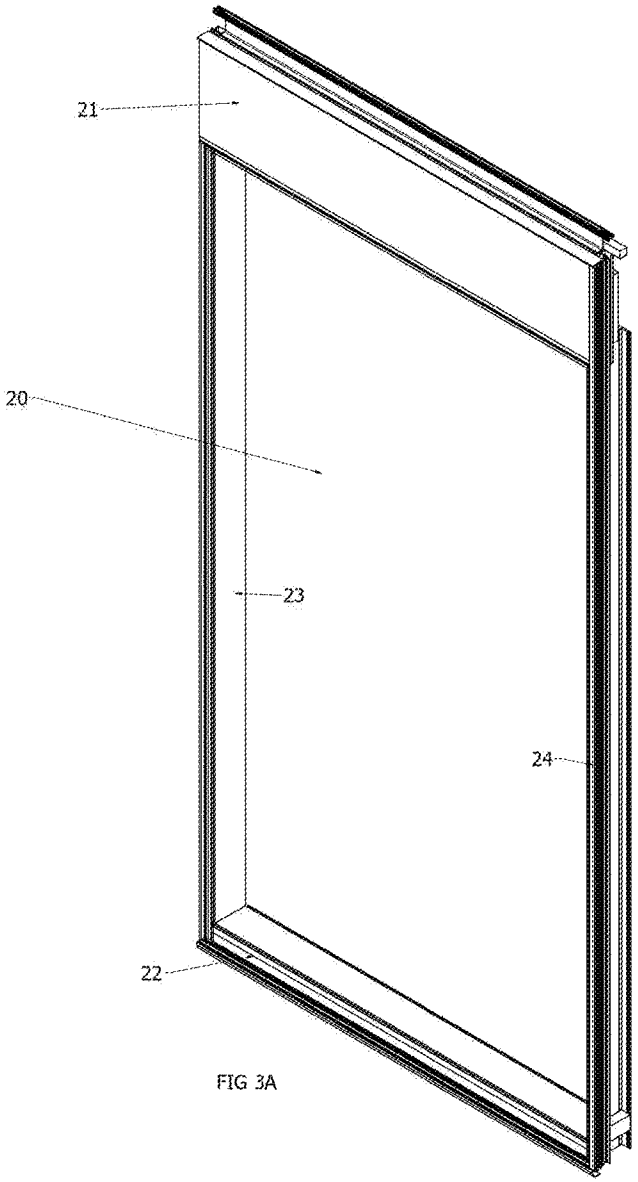
FIG 3A
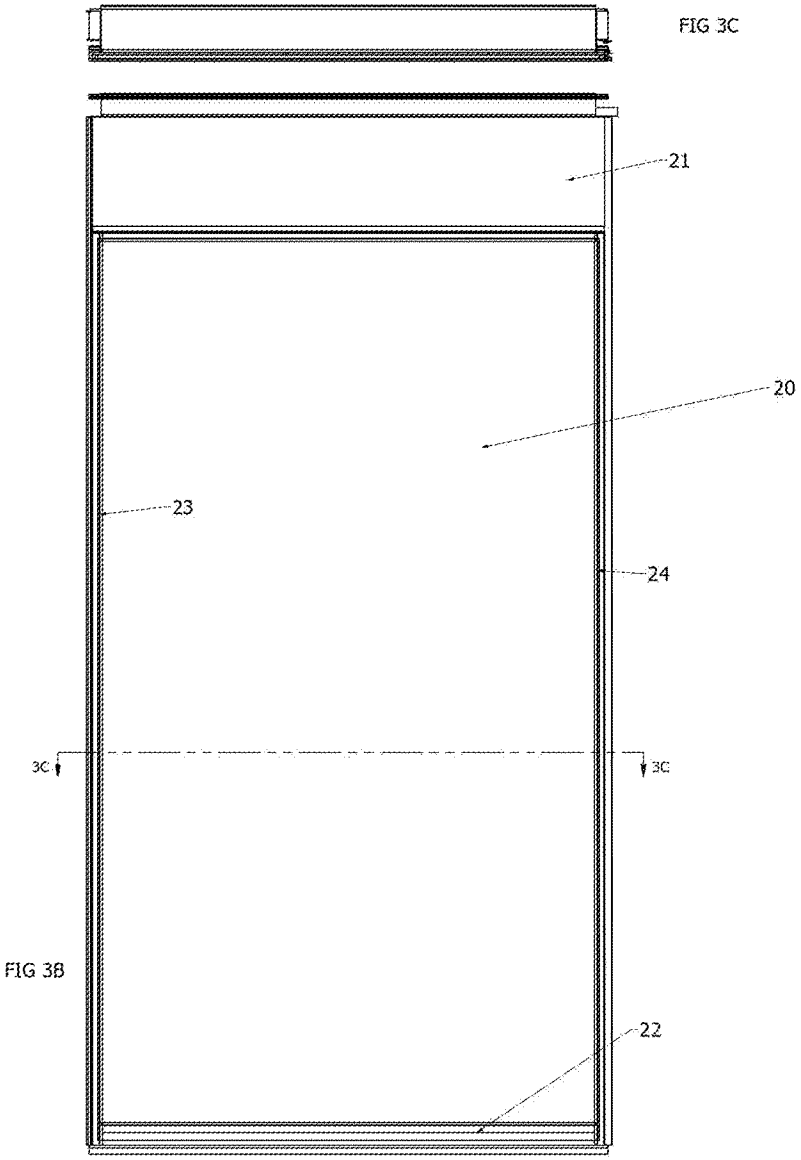
FIG 3B
FIG 3C

SYSTEMS, METHODS AND APPARATUS FOR INTERLOCKING UNITIZED CURTAINWALL BUILDING FAÇADE

FIELD OF INVENTION

The present invention relates to the exterior building envelope systems. This invention particularly relates to a façade system supported by a continuous anchor secured to the slab without embeds.

BACKGROUND TO THE INVENTION

Many buildings of current construction, particularly commercial buildings, derive no structural support from their exterior walls. Building façade systems work as envelopes around the buildings to protect the buildings from exterior elements. These walls simply isolate the interiors of the buildings from the environment outside the buildings, and as such are generally referred to as "curtainwalls". "Curtainwall" is a term typically used to describe a building facade which does not carry any dead load from the building other than its own dead load. These loads are transferred to the main building through connections, such as anchors, to the structural elements of the building, (e.g. concrete concrete slabs or columns).

The most common type of envelope is curtainwall panels or frames, supported by brackets anchored to the building. In many embodiments, curtainwalls consist of glass panels constituting a major portion of the exterior surface of the building, with structural members separating the glass panels. Curtainwall panels can be made of various materials such glass, stone, aluminum, steel, etc., and they can be sized as required by project specifications. The panels can be insulated and be different types, for example with transparent glass between concrete slabs and with opaque glass or stone or aluminum panel along the building structural components.

The structural members of the curtainwall typically form a grid consisting of mullions (i.e., vertical members) and transoms (i.e., horizontal members). The glass panels are placed between sets of mullions and transoms and supported thereby, so as to define the exterior sheathing of the building. In a rain-screen type of curtain wall system (zone drainage system), the framing about each glass panel defines a cavity between inner structural members and outer structural members. The inner structural members form a rain screen with the glass panel. The pressurized cavity between the inner and outer structural members defines a pressure zone of a pressure generally equal to that exerted on the outer structural member. The pressurized cavity is ventilated so as to allow air to enter or exit the cavity, in order to equalize the pressure in the cavity to the pressure at the exterior of the curtain wall. Accordingly, pressure increases, for instance due to wind or like atmospheric conditions, will be neutralized by the pressure zone and thus not cause infiltration through the rain screen.

Examples of patents directed to building façade systems include U.S. Pat. No. 9,752,319 to LeVan and U.S. Pat. No. 7,644,549 to Speck. Building facade frames may be typically secured to the concrete slabs. Prior frames secured to concrete slabs are, for example, shown and described in U.S. Pat. Nos. 8,959,855; 8,001,738; and, US Pat. Pub. 2015/0135615. Such building systems may have load carrying members secured to the concrete concrete slabs via embedded anchoring systems which may require elements to be pre-set within the concrete concrete slabs. These embedded anchor systems may conflict with the native placement of the steel reinforcing system for the concrete slabs and require precise installation with little tolerances for changes in building conditions. Any modifications thereto are typically done at a substantial cost.

The prior art building facade frames and systems are, however, not readily adjustable to compensate for construction tolerances of the building concrete slabs, are generally cumbersome and difficult to install and relatively costly. The building facade curtainwall systems taught by the prior art are, therefore, not readily adjustable to compensate for construction tolerances of the building concrete slabs, are generally cumbersome and difficult to install and relatively costly.

There remains a need for a building façade systems that can be used with greater ease of installation.

SUMMARY OF THE INVENTION

Accordingly, it is an aspect of this invention to at least partially overcome some of the disadvantages of the prior art.

An aspect of the present invention is directed to an interlocking unitized curtainwall building façade frame that is vertically and horizontally adjustable, the frame comprising: upper and lower transom members and first and second mullions connected to the upper and lower transom members to form a frame body, the upper transom member releaseably engagable with an anchor member spanning the width of the upper transom affixed to a concrete slab, the anchor member having a general L or C shape with each arm or portion of the L or C having a number of pre-punched anchor holes for attaching to the concrete slab and for attaching to the upper transom.

Another aspect of the present invention is directed to the interlocking unitized curtainwall building façade frame wherein the anchor holes are aligned in relation to each other.

Another aspect of the present invention is directed to the interlocking unitized curtainwall building façade frame wherein the anchor holes are staggered in relation to each other.

Another aspect of the present invention is directed to the interlocking unitized curtainwall building façade frame wherein the upper transom member is comprised of a first and second horizontal member, the first horizontal member releasably engagable with an upper surface the concrete slab through the anchor member and the second horizontal member engaging with a lower surface of slab to provide a seal between the frame and the concrete slab.

Another aspect of the present invention is directed to the interlocking unitized curtainwall building façade frame wherein the anchor member has a generally horizontal arm portion and a generally vertical arm portion, whereby the generally horizontal arm portion is secured to the upper surface of the concrete slab and the generally vertical arm portion is affixed to the first horizontal member of the upper transom.

Another aspect of the present invention is directed to the interlocking unitized curtainwall building façade frame wherein the horizontal and vertical arm portions of the anchor member are each provided with lip portions.

Another aspect of the present invention is directed to the interlocking unitized curtainwall building façade frame wherein the generally vertical arm portion of the anchor member is secured to the upper transom with multiple fasteners provided in the anchor holes of the vertical arm portion.

Another aspect of the present invention is directed to the interlocking unitized curtainwall building façade frame wherein the generally horizontal arm portion of the anchor member is secured to the upper surface of the concrete slab with multiple fasteners provided in the anchor holes of the horizontal arm portion.

Another aspect of the present invention is directed to the interlocking unitized curtainwall building façade frame wherein the vertical arm portion has a shorter length than the horizontal arm portion.

Another aspect of the present invention is directed to the interlocking unitized curtainwall building façade frame wherein the bottom transom engages with an upper transom of a second frame to provide a horizontal seal between the first and second frame and the first and second mullions engage with second and first mullions of a third and fourth frame to provide vertical seals, the second frame located below the frame and the third and fourth frames adjacent the frame.

Another aspect of the present invention is directed to the interlocking unitized curtainwall building façade frame wherein insulation material is provided between the frame and the concrete slab.

Another aspect of the present invention is directed to the interlocking unitized curtainwall building façade frame wherein the insulation material is insulation or fire stopping material Another aspect of the present invention is directed to the interlocking unitized curtainwall building façade frame wherein the anchor member provides a smoke or sound barrier between the concrete slab and the frame.

Yet another aspect of the present invention is directed to an interlocking unitized curtainwall building façade system that is vertically and horizontally adjustable, the system comprising: a first frame having upper and lower transom members and first and second mullions connected to the upper and lower transom members to form a first frame body, the upper transom member engaging a continuous anchor member spanning the width of the upper transom affixed to a first concrete slab, the anchor member having a general L shape with each arm of the L having a number of pre-punched anchor holes for attaching to the first concrete slab; and a second frame having upper and lower transom members and first and second mullions connected to the upper and lower transom members to form a second frame body, the upper transom member engaging a continuous second anchor member spanning the width of the upper transom affixed to a second concrete slab, the second anchor member having a general L shape with each arm of the L having a number of pre-punched anchor holes for attaching to the second concrete slab and engaging with the first frame; and wherein the bottom transom of the first frame engages with the upper transom of the second frame to provide a horizontal seal between the first and second frame.

Yet another aspect of the present invention is directed to the interlocking unitized curtainwall building façade system wherein the continuous anchor of the first frame is secured to a top surface of the first concrete slab with concrete screws or nail-in pins.

Yet another aspect of the present invention is directed to the interlocking unitized curtainwall building façade system wherein the anchor holes of the first and second anchor members are aligned in relation to each other.

Yet another aspect of the present invention is directed to the interlocking unitized curtainwall building façade system wherein the anchor holes of the first and second anchor members are staggered in relation to each other.

Yet another aspect of the present invention is directed to the interlocking unitized curtainwall building façade system wherein the upper transom of the first frame is comprised of a first and second horizontal member, the first horizontal member engaging an upper surface the first concrete slab through the anchor member and the second horizontal member of the first frame engaging with a lower surface of first concrete slab to provide a seal.

Yet another aspect of the present invention is directed to the interlocking unitized curtainwall building façade system wherein the first and second anchor member each have a generally horizontal arm portion and a generally vertical arm portion, whereby the generally horizontal arm portion is secured to the upper surface of the concrete slab and the generally vertical arm portion is affixed to the upper transom member.

Yet another aspect of the present invention is directed to the interlocking unitized curtainwall building façade system wherein the horizontal and vertical arm portions of the anchor member are each provided with lip portions.

Yet another aspect of the present invention is directed to the interlocking unitized curtainwall building façade system wherein the anchor holes of the vertical arm portion of the first and second anchor are secured to the upper transom of the first and second frame with multiple fasteners.

Yet another aspect of the present invention is directed to the interlocking unitized curtainwall building façade system wherein the bottom transom of the first frame engages with the upper transom of the second frame to provide a horizontal seal and the first and second mullions engage with second and first mullions of a third and fourth frame to provide vertical seals.

Yet another aspect of the present invention is directed to the interlocking unitized curtainwall building façade system wherein insulation material is placed between each frame and each concrete slab.

Yet another aspect of the present invention is directed to the interlocking unitized curtainwall building façade system wherein the insulation material is insulation or fire stopping material Yet another aspect of the present invention is directed to the interlocking unitized curtainwall building façade system wherein each anchor member affixed to each frame provides a smoke or sound barrier between adjacent concrete slab.

Yet another aspect of the present invention is directed to the interlocking unitized curtainwall building façade system wherein the frames of a curtain wall system are installed in a counter clockwise sequence and from the bottom up.

Yet another aspect of the present invention is directed to a method for installing an interlocking unitized curtainwall building façade system that is vertically and horizontally adjustable, the system comprising: a first frame having upper and lower transom members and first and second mullions connected to the upper and lower transom members to form a first frame body, the upper transom member engaging a continuous anchor member spanning the width of the upper transom affixed to a first concrete slab, the anchor member having a general L shape with each arm of the L having a number of pre-punched anchor holes for attaching to the first concrete slab; and a second frame having upper and lower transom members and first and second mullions connected to the upper and lower transom members to form a second frame body, the upper transom member engaging a continuous second anchor member spanning the width of the upper transom affixed to a second concrete slab, the second anchor member having a general L shape with each arm of the L having a number of pre-punched anchor holes for attaching to the first concrete slab adjacent the first anchor member; the method comprising: attaching the first and second anchors to the first concrete slab adjacent each other; releasably engaging the first vertical mullion of the first frame with the second vertical mullion of the second frame to provide a vertical seal between the first and second frame; attaching the first and second frames to the first and second anchor; and leveling the first and second frames.

BRIEF DESCRIPTION OF THE DRAWINGS

In the drawings, which illustrate embodiments of the invention:

FIGS. 3A to 3H provide a preferred embodiment of the present invention.

DESCRIPTION OF THE PREFERRED EMBODIMENTS

Figure 1A:
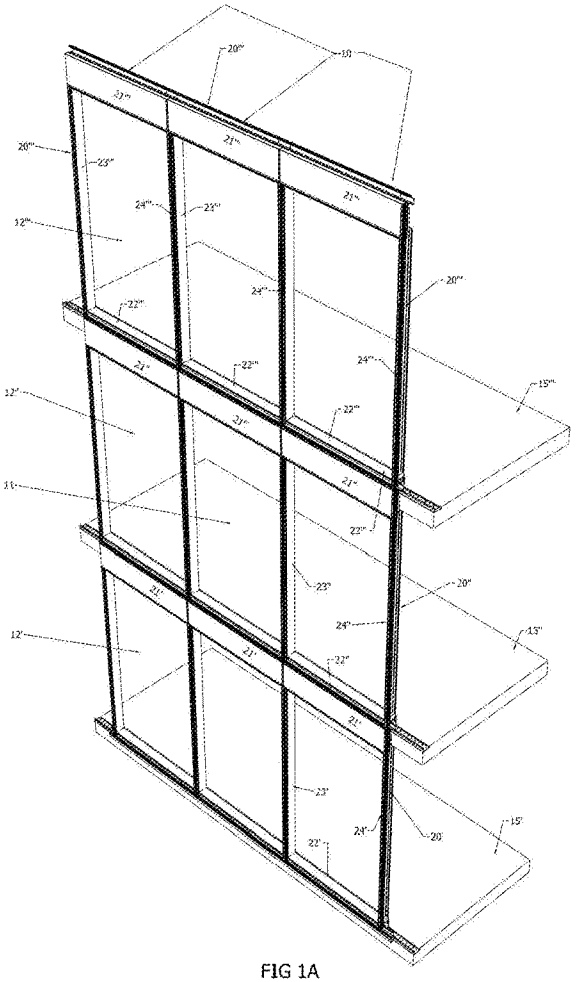
FIGS. 1A to 1D provide a preferred embodiment of the present invention.

The description that follows, and the embodiments described therein, is provided by way of illustration of an example, or examples, of particular embodiments of the principles and aspects of the present invention. These examples are provided for the purposes of explanation, and not of limitation, of those principles and of the invention.

It should also be appreciated that the present invention can be implemented in numerous ways, including as a process, method, an apparatus, a system, a device or a method. In this specification, these implementations, or any other form that the invention may take, may be referred to as processes. In general, the order of the steps of the disclosed processes may be altered within the scope of the invention. The description that follows, and the embodiments described therein, is provided by way of illustration of an example, or examples, of particular embodiments of the principles and aspects of the present invention. These examples are provided for the purposes of explanation, and not of limitation, of those principles and of the invention.

It will be understood by a person skilled in the relevant art that in different geographical regions and jurisdictions these terms and definitions used herein may be given different names, but relate to the same respective systems.

It will be understood by a person skilled in the relevant art that the term "transom" will referred to a transverse horizontal structural beam, bar or crosspiece. This contrasts with a "mullion", which is a vertical structural member. It will be understood by a person skilled in the relevant art that frame is generally composed of at least two transoms and at least two mullions.

Preferred embodiments of the present invention can be implemented in numerous configurations depending on implementation choices based upon the principles described herein. Various specific aspects are disclosed, which are illustrative embodiments not to be construed as limiting the scope of the disclosure. Although the present specification describes components and functions implemented in the embodiments with reference to standards and protocols known to a person skilled in the art, the present disclosures as well as the embodiments of the present invention are not limited to any specific standard or construction technique.

The preferred embodiment of the present invention are directed to a "curtain wall" system, whereby it will be understood by a person skilled in the art would understand that the term "curtain wall" references a wall that encloses the space within a building but does not provide any structural support. Given this, it will be understood that curtain walls differ from structural elements, which may be designed to span multiple floors, taking into consideration design requirements such as thermal expansion and contraction; building sway and movement; water diversion; and thermal efficiency for cost-effective heating, cooling, and lighting in the building. It will be understood that curtain wall systems transfer back to the structure elements both their own dead load plus any live loads, which consist primarily of positive and negative wind loads but might also include a snow load applied to large horizontal areas, seismic loads, maintenance loads and others. Curtain wall systems may also move due to thermal changes and wind significantly different than movement of the building structure. Therefore the connections that anchor the curtain wall system to the building's structural elements should be designed to allow differential movement while resisting the loads applied. Curtain wall systems are typically designed with steel or extruded aluminum or aluminum alloy framing members. A person skilled in the art will appreciate that other materials can be used for the anchors and other structural or framing elements, including, but not limited to, aluminum alloys (more preferably 6061-T5/T6, 6063-T5/T6). A person skilled in the art will appreciate that other materials can be used for non-structural items and thermal and/or sound barriers, rigid and non-rigid, including, but not limited to, PVC (Polyvinylchloride) plastic, EPDM (Ethylene Propylene Diene Momomer) rubber for gaskets or caulking, silicone rubber for gaskets or caulking, polyamide 6.6 (synthetic Polymer), structural silicone for glazing the sealed units to the curtain wall system, structural silicone to create the bond between two lites of glass, silicone sealant (non-structural) for seals in curtain wall system and for installation. A person skilled in the relevant art will understand that these silicones vary depending on use and application. A person skilled in the relevant art will understand that fire stop silicone (non-structural) may be used for seals on sill anchor to substrate and anchor to frame. A person skilled in the relevant art will understand that stainless steel fasteners (screws, nuts, bolts, etc.) may be used for assembly of curtain wall and other items, carbon steel fasteners with 2000 hour salt spray testing may be used for interior items (not exposed to water). A person skilled in the relevant art will understand that for sealed units, the following may be used: Interior Glass Lite (4 mm-10 mm thickness), PIB (Polyisobutylene) located on interior and exterior surface of glass spacer, Glass Spacer (Stainless Steel, Aluminum, Hybrid—depending on thermal requirements), Exterior Glass Lite (4 mm-10 mm thickness), Gas fill in sealed unit (Argon, Krypton, Air—for improved thermal performance). Foam Blocks (Low Perm polyether foam) located at top of curtainwall tubes as air barrier up "chimney" of verticals, steel (formed) for sill anchors.

A portion of an outer wall or shell of a building 10 with three stories may be seen in FIG. 1A. After installation on the building structural elements or system, the outer wall of the building 11 includes a plurality of curtain wall sections or frames 20 being seen, for example, in FIG. 1A. As may be appreciated from the FIGS., the curtain wall sections or frames within each floor level can be hung sequentially. For example, each of the sections or frames of curtain wall may be hung (e.g. installed) in sequence and when one floor level is completed the undertaking of commencement of the next upper floor level is begun. It will be understood as set out herein, that the use of the present invention aids in the speed and accuracy of the installation. It will be understood that once a floor level has been completed the next floor level can be added until the installation is complete.

Curtain wall systems may be classified by their method of fabrication and installation as unitized (also known as modular) systems. In a unitized system, the curtain wall is composed of large units, modules or frames. These modules are assembled in a factory, shipped to the site and erected on the building site. Vertical and horizontal mullions of the modules mate together with the adjoining modules through various fixing or attachment means (see the discussion herein). Modules or frames of a curtain wall system (see, for example, 20 in FIG. 1A) are generally constructed one building story tall (typically approximately 9 to 14 feet tall, depending on the parameters of the building) and one module wide. A "story" is any level part of a building with a floor that could be used by people (for living, work, storage, recreation). The height of each story is based on the ceiling height of the rooms plus the thickness of the floors between each pane. Generally, this is around 14 feet (4.16 m) total; however, it varies widely depending on the building demands. Typical units or modules have a width of typically between 1 to 6 feet, but it will understood by a person skilled in the relevant art that various widths can be accommodated based on the design and construction parameters of the building or structure.

In addition to curtain walls, a person skilled in the art would understand that aspects of the present invention could also be used in association with window wall systems. While curtain walls install in front of the concrete concrete slab, "window walls" span the slab heights and install between the slabs which can influence the overall cost, schedule, quality, etc. Window walls may offer cost savings by offering savings in material, labor to install and caulking for weathering when compared with a curtain wall system. Additional time and cost savings may come through the elimination of fire-stopping required to insulate gaps at the slab locations created by curtain wall application.

In one embodiment of the present invention, there is provided a building facade system including one or more framing units or members, such as transom and mullion members. The framing members can be secured to one another with various fasteners which extend at least partially through the individual framing member and can threadingly or otherwise engage therein. In addition to the framing members, there may also be provided one or more cap or cover members that can be secured directly or indirectly to the framing members to cover exposed fasteners, gaps, etc. from view upon completion of the installation. Such cap or cover members may also provide a seal. On or more of the framing members are attached to concrete slabs, the placement and distance between these elements being variable. In a preferred embodiment, at least one of the transom members may be anchored or otherwise affixed to the concrete slab through a continuous anchor. In a preferred embodiment, the length of the continuous anchor generally corresponds to the width of the module. In yet a preferred embodiment, the length would correspond to the perimeter of the building concrete slab within any given floor plate. In a preferred embodiment, the continuous anchor extends the length of the concrete slab. In a more preferred embodiment, the length of continuous anchor typically ranges from 8 to 10 foot. Additional benefits of the continuous anchor may include: (a) forming a barrier between floors for further compartmentalizing the floor sections; (b) creating an environment barrier between one living space and another; and (c) creating smoke and/or sound seals. There may also be provided a temporary weather seal during construction in order to stop rain from damaging lower floors. In a preferred embodiment, the continuous anchor may be composed of steel, however it will be understood that other materials, including those noted herein, could be used provided such material has the necessary characteristics to hold the frame member in place.

It will be understood by a person skilled in the relevant art that the modules or frames of the curtain wall may be formed to any dimension depending on the building requirements. Generally, the size of each module or frame can be dictated by building construction carried out in accordance with local building codes, building requirements and design choices. Specifications which are drawn under a typical code may dictate that the dimension between the bottom of one concrete slab and the top of an adjacent concrete slab be 96-170 inches (about 244-431 cm); that the concrete slab be 6-14 inches (about 15-36 cm) in thickness. Therefore, the intermediate sections of curtain wall to be hung on the anchor or shelf member structure supported by the concrete slabs will have a width between centers of mullions 12-72 inches (about 30-183 cm) and a height or length of 96-170 inches (about 244-431 cm). The mullions may be up to 4 inches (about 10 cm) in width. The anchor members of the present invention, in preferred embodiment would generally match the dimensions of the frame. The present invention will also provide a suitable degree of tolerance in the height, length or width dimensions of the various members so as to permit expansion of the curtain wall sections without development of compressive internal stress in one section. The variation is to take into account the variations in the construction. One is the tolerance of the structure to which the system of the present invention is attached (approximately +/−1 inch in any direction). Another reason for the desired tolerance of the present invention is that after construction and installation of the system, the building will likely be in motion. The present system of the present invention provides for movement akin to a suit of amour for buildings that are dynamic. The system of the present invention provides greater flexibility for window wall and curtain wall product installation. The system of the present invention is effectively a hybrid between the curtain wall systems and the window wall systems.

An aspect of the present invention is directed to an interlocking or interconnected unitized curtainwall building façade system that is vertically and horizontally adjustable in the field (e.g. at the building site). As shown in FIG. 1A, system 10 of the present invention can be used in a building 11 under construction having a reinforced concrete slab or floor 15. As can be seen from FIG. 1A, building 11 is provided with three stories (also referred to as floors), but as will be understood by a person skilled in the art, any number of stories 12 (see for example 12', 12" and 12'" in FIG. 1A) may be provided during construction of building 11; each story provided with a reinforced concrete slab 15 (15', 15", and 15'") which acts as the floor for that story. System 10 comprises multiple vertically and horizontally interlocking or interconnected unitized curtainwall modules or frames 20 for each story 15 with each frame having upper and lower transom members 21, 22 and left and right side mullion 23, 24. It will be understood that the frames, except for the embodiments described herein, are of general constructions well known to a person skilled in the relevant art.

In a preferred embodiment, upper transom 21 may be composed of two members 21*a* and 21*b*. In a preferred embodiment, as shown, for example, in FIG. 2A, transom member 21*a*''' releasable engages with upper surface 15*a* of slab 15 through anchor member 16, as described below. Transom member 21*b*'' directly or indirectly engages with the lower surface 15*b* of slab 15 to provide a seal as described below.

Figure 1B:
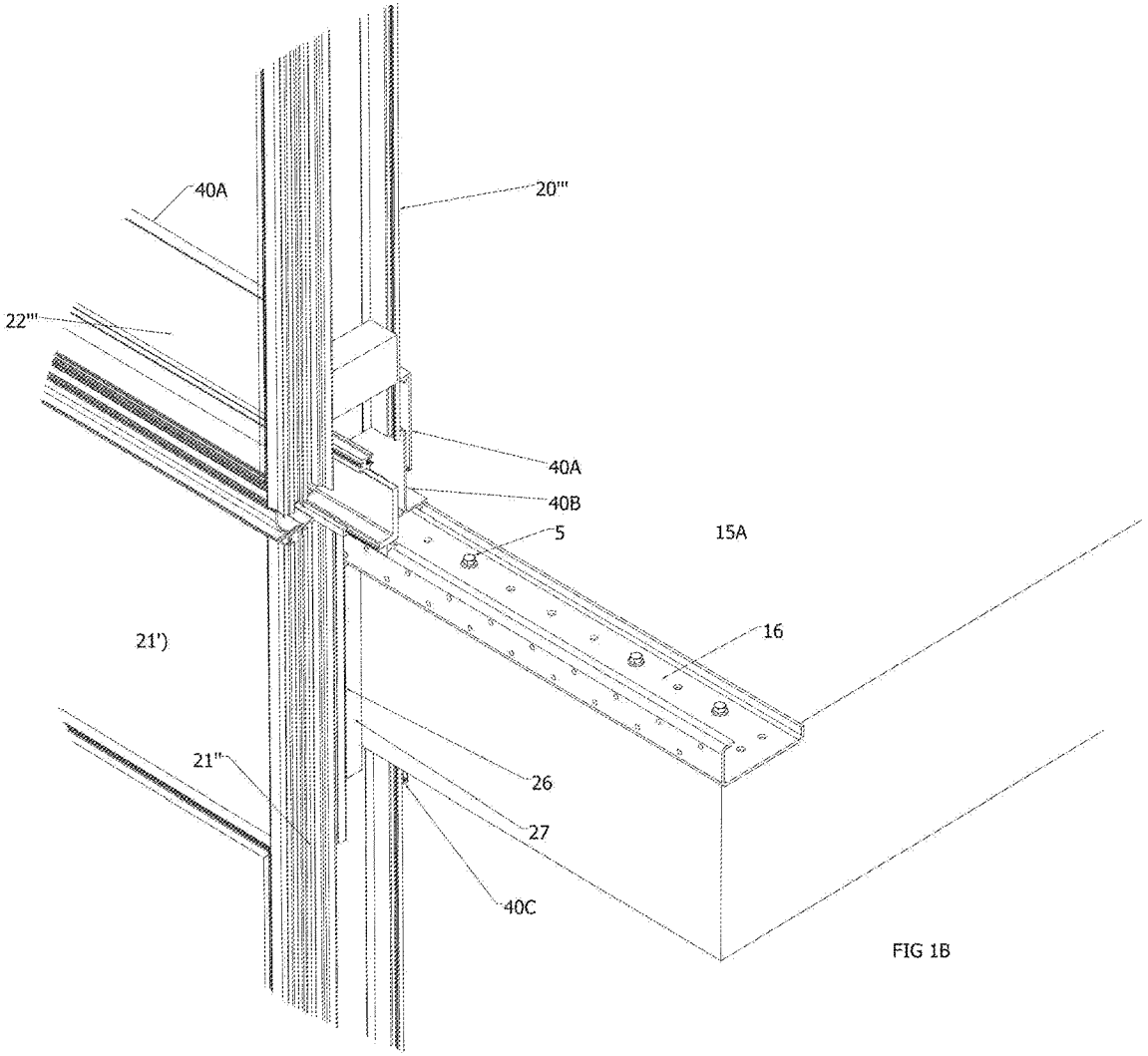
Figure 1D:
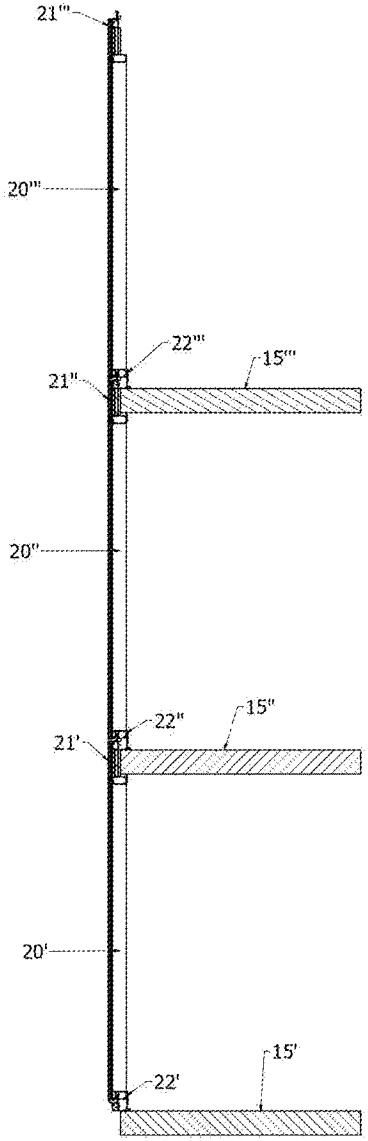
Figure 1C:
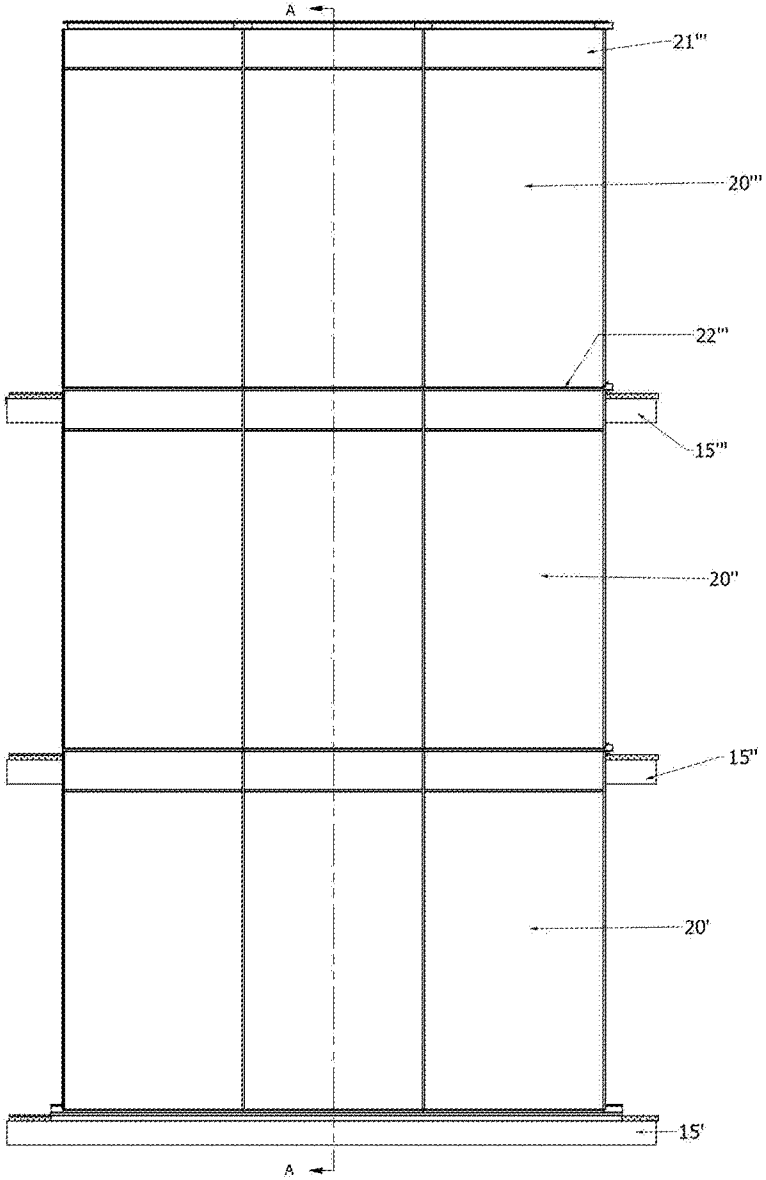
Figure 4A:
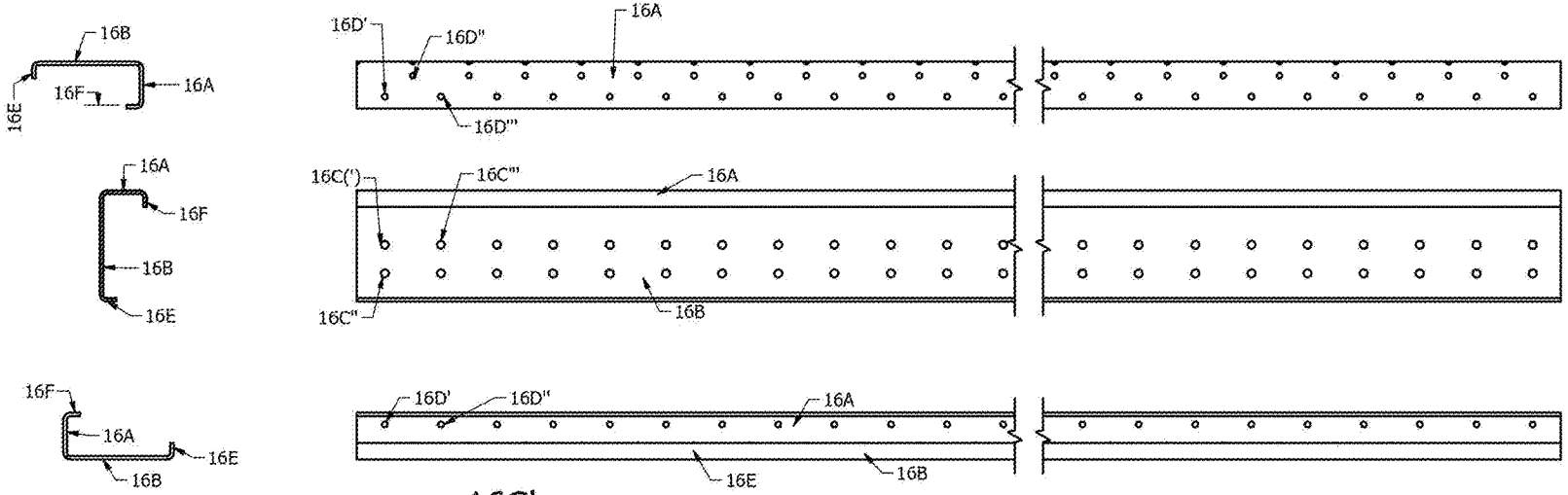
FIGS. 4A and 4B provide a preferred embodiment of the present invention.
Figure 4B:
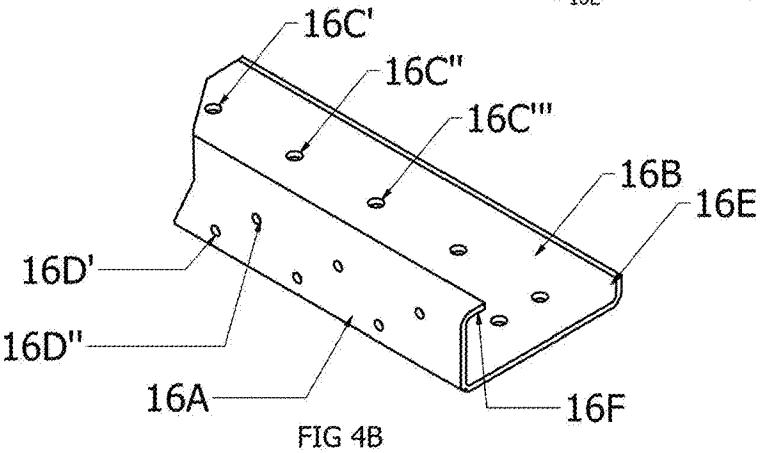

FIG. 1B shows an exploded cutaway view of a section of the system shown in FIG. 1A. As shown in FIG. 1B, upper transom member 21 may be indirectly anchored to the upper surface 15*a* of concrete slab 15 through an anchor member 16 having a general L or C shape with each arm or portion having a number of pre-punched anchor holes or attachment locations (see, for example, FIG. 4B). In a preferred embodiment, the anchor holes are aligned with one another or may be staggered in relation to each other. The exact design will be dictated based on building requirements, building codes or building design choices. The elongated or extended horizontal arm portion 16*b* of anchor 16, which in a preferred embodiment is generally L shaped or C shaped (as provided in FIG. 1B), can be secured to the upper surface 15*a* of the concrete slab 15 with multiple medium to heavy duty anchors (see 5 in FIG. 1B) provided through the anchor holes or attachment locations 16*c* of the extended arm portion 16*b* of anchor member 16. Anchor member 16 is continuous in a preferred embodiment and would span the entire width of the frame 20. As shown in FIGS. 4A and 4B, anchor member 16 may also have, in a preferred embodiment, a shortened vertical arm portion 16*a* with multiple anchor holes or attachment locations 16*d*. It will be understood that the terms vertical and horizontal in reference to anchor 16 are references used when anchor 16 is installed as is provided in FIG. 2A, for example. As can be seen in FIG. 4A, arm portions 16*a* and 16*b* can be provided with lip portions 16*e* and 16*f*. In a preferred embodiment, lip portions 16*e*/16*f* may provide a smoke seal, in conjunction with applied silicon (or other suitable material) caulking (see, for example, FIG. 2A). The lip portions assist in providing attachment of the caulking. 16*f* extends generally perpendicular to the direction of 16*a* (parallel to extended arm 16*b*) while 16*e* extends generally perpendicular to the direction of 16*b* (parallel to shortened vertical arm 16*a*). As can be seen in FIGS. 4A and 4B, the anchor holes 16*c*, 16*d* may be aligned or may be provided staggered. In a preferred embodiment as provided in FIGS. 4A and 4B, anchor holes 16*c* are aligned, while anchor holes 16*d* are staggered. It will be understood by a person skilled in the relevant art, that any pattern of anchor hole or slot arrangement in arms 16*a*,16*b* of anchor member 16 may be provided in the present invention as the use of multiple anchors results in less or no interference with the reinforcing materials (e.g. reinforcing steel, reinforcement steel, rebar, etc.) used in the creation of concrete slab 15. This configuration may thus speed installation of the system 10. The pre-punched anchor holes or attachment locations 16*c*,16*d* (such as, for example, slots) afford greater site tolerance accommodation than pre-determined or pre-set hole/slot locations that are fixed in the concrete slab 15.

Figure 2A:
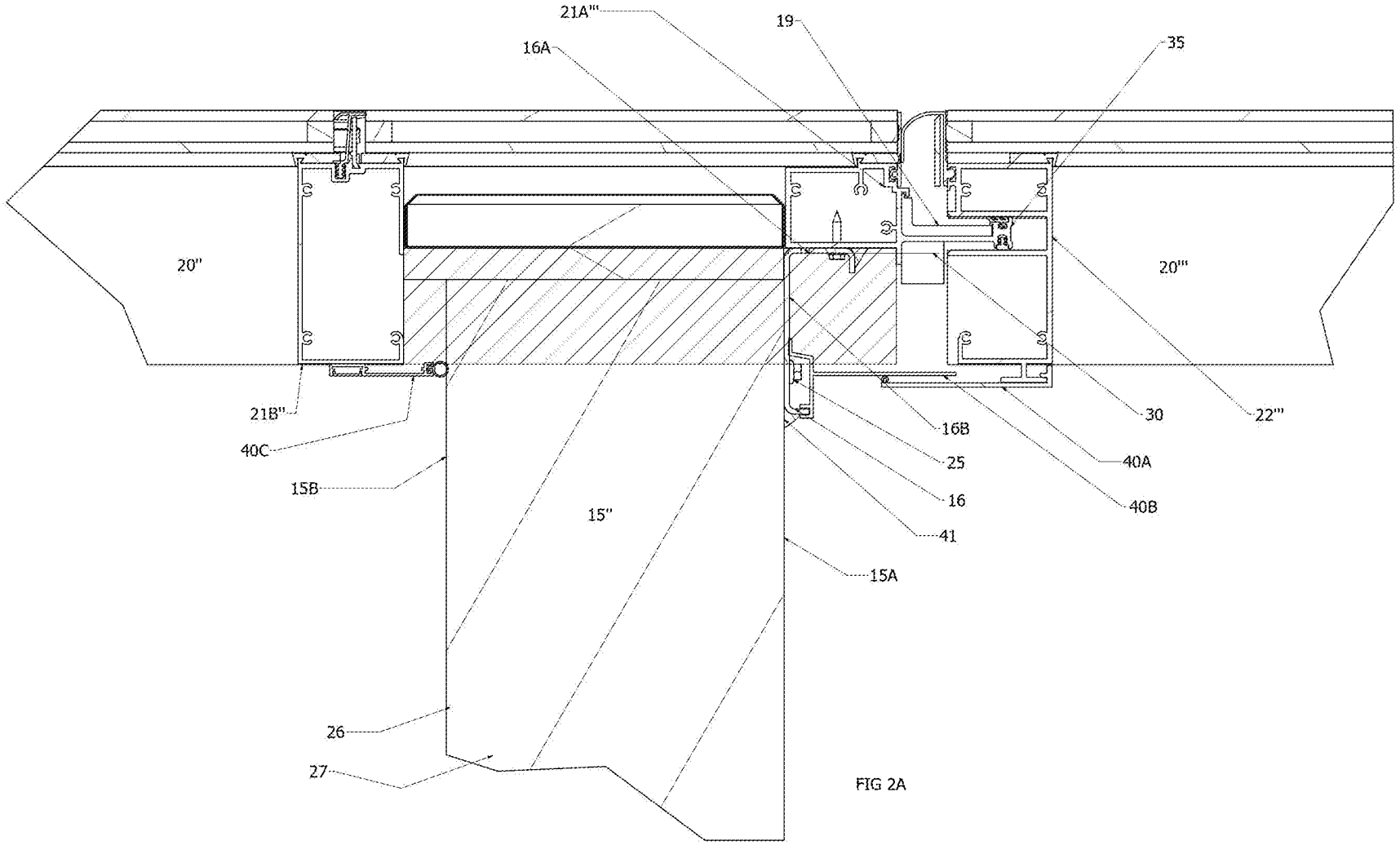
FIGS. 2A to 2C provide a preferred embodiment of the present invention.

In a preferred embodiment as shown in FIG. 2A, shortened vertical arm portion 16*a* of the anchor 16 may be secured to the top or upper transom 21 (preferably 21A) with multiple fasteners or other anchors 25 provided in the anchor holes or attachment locations 16*d* of the shortened or vertical arm portion 16*a*. In a preferred embodiment as shown in FIG. 2A, extended horizontal arm portion 16*b* of the anchor 16 may be secured to the top surface 15*a* of slab 15 with multiple fasteners or other anchors 25 provided in the anchor holes or attachment locations 16*c* of the extended arm portion 16*a*. The top horizontal transom 21, fastened to vertical mullions 23-24, is thereby considered "hanging", and as such, so is frame 20. As shown in greater detail in FIG. 2A, the bottom transom 22*a*' of upper frame 20''' will engage with the upper transom 21*a*'' of lower frame 20'' to provide for a seal thus completing the curtainwall. In a preferred embodiment, as shown in FIG. 2A, additional material may be provided between frame 20 and concrete slab 15. For example, backpan and insulation 26 as well as fire stopping material 27 may be provided, if, for example, dictated by the design or applicable building codes.

Vertical mullions 23-24 can be configured to engage with each other so as to provide a seal with system 10 is provided. For example, mullion 23 has matting members 23*a* and 23*b* to engage with matting members 24*a* and 24*b* so as to engage, this forming the necessary vertical seal between frames 20.

It will be understood by a person skilled in the relevant art that components used in building construction may be fabricated, assembled or formed on site, often by hand, in conditions that may be less than ideal, and using materials with inherent imperfections. It is impossible to construct, for example, concrete that is perfectly straight, simply by virtue of the inherent properties of the material itself. For this reason, it is an aspect of the present invention to allow for in-built tolerances to be able to work around such imperfections and/or defects. More specifically, an aspect of the present invention allows for flexibility when accommodating variations in neighboring elements. Even when individual elements or frames appear to be close to what was specified, variations can accumulate when a number of components are assembled, and this can create a clash with an item that may have a low tolerance. This is becoming more important as the number of items prefabricated off site has increased, and so there is less scope for changes on site to make things fit. In addition to dimensions, tolerances may be used to specify allowable variations in strength, stability, the mix of a material, the performance of a system, temperature ranges and so on.

In a preferred embodiment, anchor 16, when sealed, may act as a smoke barrier between concrete slabs 15 (see FIG. 2A for example). The anchor 16 may also act as an effective acoustical barrier between concrete slabs 15. These are used to restrict the movement of or penetration of smoke, noise, etc. Unique applied edge covers 40 eliminate the need for site applied caulking benefitting economics, speed of installation and provides an improved finished appearance. Incorporation of a stacking shim 30 at the vertical join between frames 20 allows for faster installation and lessens the need to survey each frame for placement.

The present invention provides an interlocking unitized curtainwall façade system having multiple frames with each frame having a top horizontal transom 21 anchored via a continuous anchor 16 to the upper surface 15*a* of the concrete slab 15 through. The continuous anchor 16 is secured to the top surface 15*a* of the concrete slab 15 with concrete screws or nail-in pins 5 with no need for cast in embeds or deep penetrating expanding or threaded fasteners which often are problematic because of interference with concrete reinforcing bars. The continuous anchor 16 is furnished already provided with staggered holes and slots patterns in the side in which it is fixed to the top transom 21.

These holes and/or slots work to accommodate slab 1 top and bottom tolerance and thermal expansion-contraction of the frame and make for easy and fast installation on the field. The continuous steel anchor 16 is also furnished with pre-punched holes 4 in the side in which it is anchored to the top surface of the slab 2. These holes accommodate slab 15 in and out tolerance and permit the installation in the field without serration between the screw anchors 5 and the continuous steel support 16 with a beneficial cost and time saving for installation sequence. The pattern provides the ability to get the flexibility of the systems.

The top horizontal transom member 21 is square cut and runs between and fastens to vertical mullions 23-24 thereby making the system more economical to manufacture.

Vertical movement joint 35 of the system is located at the engagement between upper or top transom 21*a*" and bottom or lower transom members 22*a*''' of frame 20. The water tightness of the joint may secured by a gasket 35 (e.g. a continuous peroxide cure EPDM gasket) installed on the factory to the top transom member 21 and overlapping to the bottom transom member 14 at the completion of field installation. In a preferred embodiment, the total dimension of the vertical movement joint may be 20 mm (¾").

As shown in FIG. 2A, vertical mullions 23-24 can be notched (see hatched portion) around the concrete slab 15 eliminating the need for the traditional smoke seal and fire stop typically needed for a unitized curtainwall system. The continuous anchor 16 at the top of each frame may also act as a smoke and acoustical separation once sealed 41 to the concrete slab 15. A site applied plug with an up-stand complete with a load transfer bar 19 is installed on top of the open vertical mullions 23,24 and sealed into place after unitized module is coupled and set into position to eliminate the need for the notching of the transom profile typically seen on traditional unitized curtainwall systems.

Figure 2B:
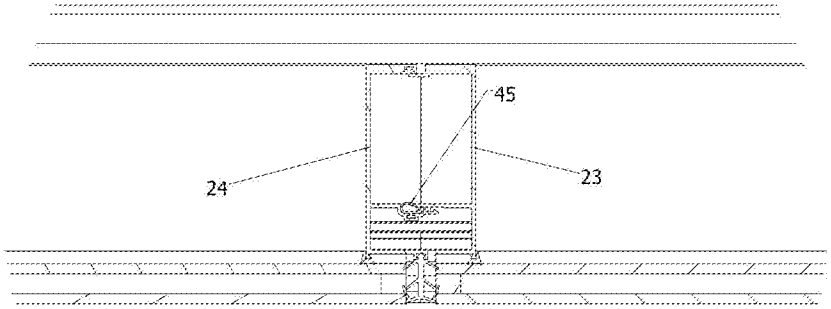
Figure 3D:
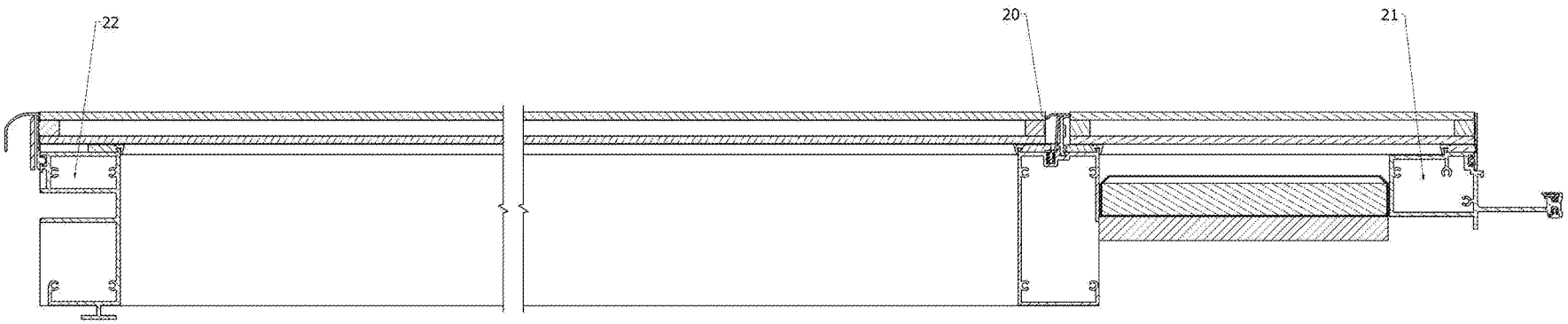
Figure 3G:
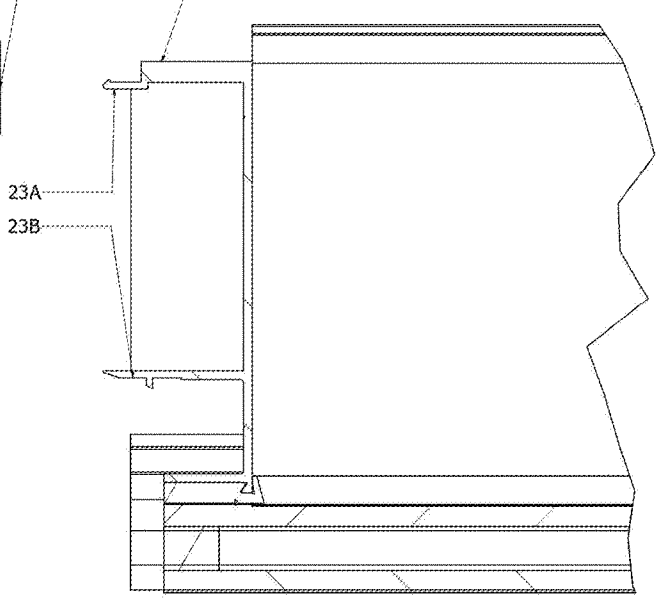
Figure 3F:
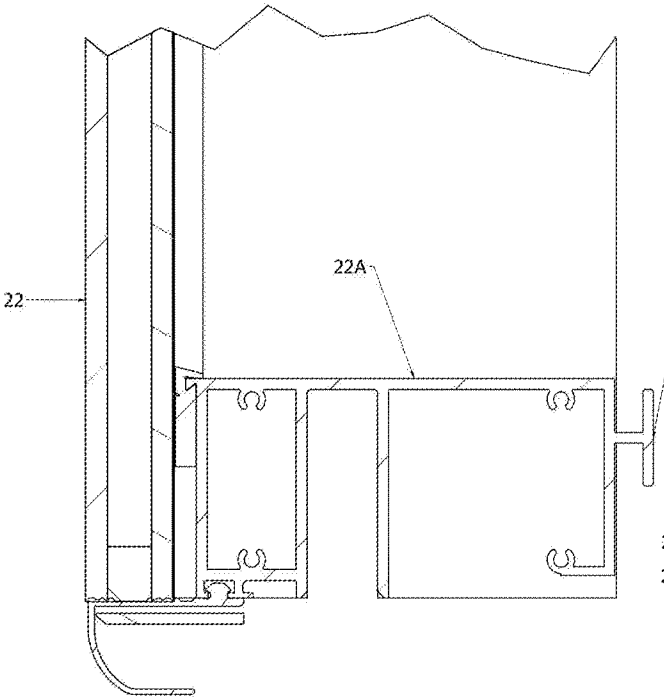
Figure 3E:
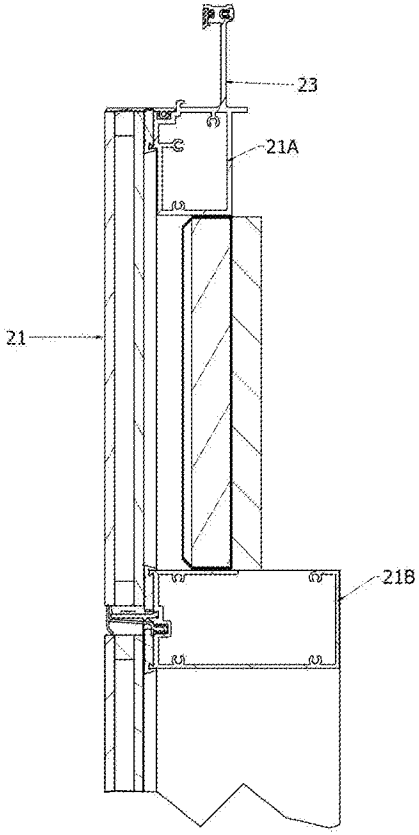
Figure 3H:
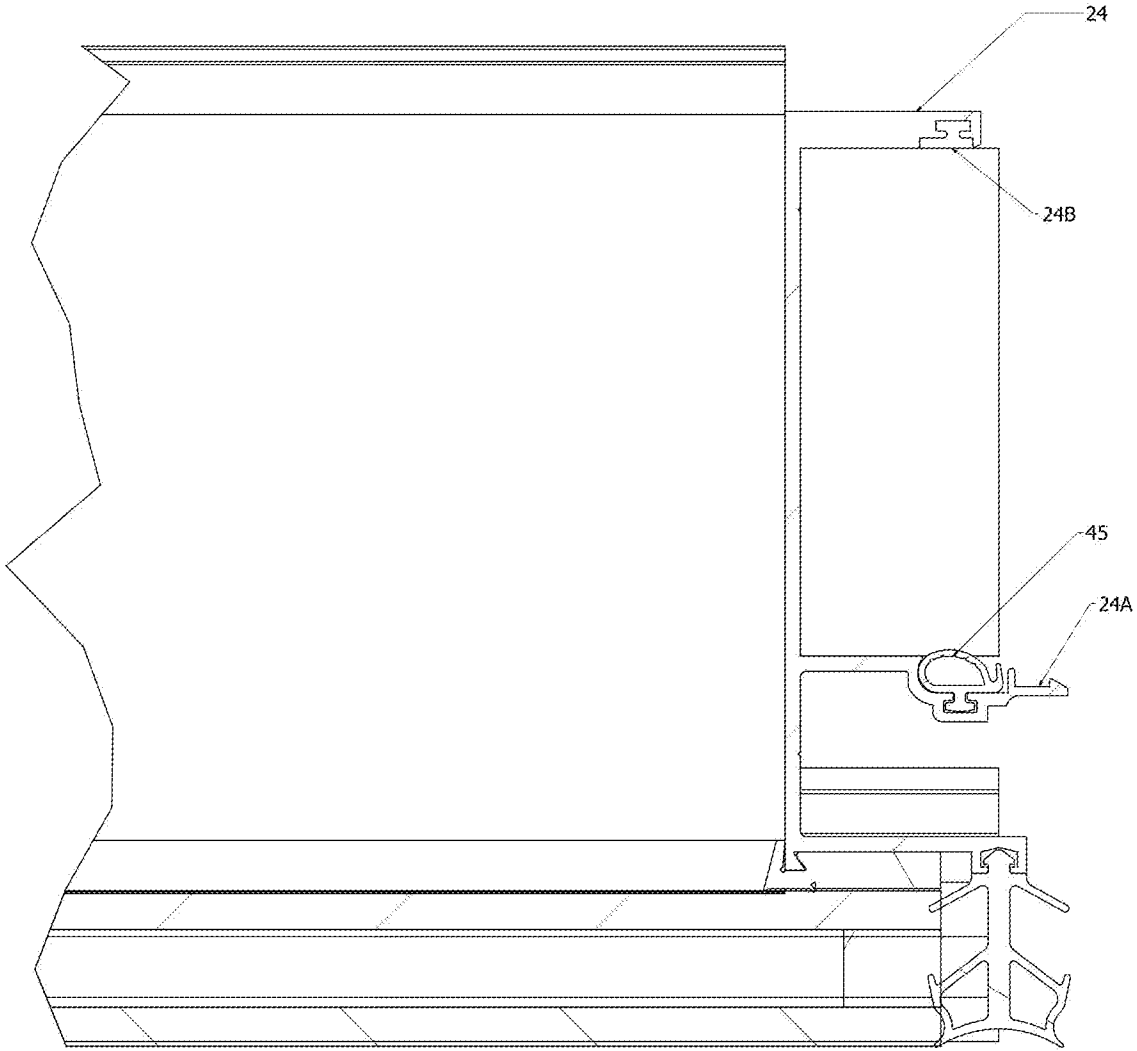

The frames of a curtain wall system are typically installed in a counter clockwise sequence and from the bottom up. In a preferred embodiment, two or more frames 20 may be vertical engaged through mullions 23, 24 so as to be sealing connected; the connected frames may then be lowered over (e.g. on top of as shown in FIG. 1A) the levelled frame on the first leveled story below onto a temporary stacking shim 30 to establish the module height. A series of self-drilling screws are used to screw anchor 16 to the back of the top horizontal transom 21*a* when the module is set into the correct position. The vertical split mullions have horizontal left-right adjustment capability +/−2.5 mm (3/32"). This reduces the time necessary for field installation and regulation because this system is able to accommodate more manufacturing and site tolerances than a traditional curtain wall system. Vertical mullions 23-24 are generally rectangular shape in cross section and comprise interlocking units 23*a,b* and 24*a,b* (see FIGS. 3G and 3H). In a preferred embodiment, units 23*a,b* and 24*a,b* interlock to form a vertical seal between frames 20 (see FIG. 2B). In a preferred embodiment, vertical air-seal gasket 45 (in a preferred embodiment, gasket 45 may be peroxide cure EPDM) may be factory installed to mullion 24 so as to secure the water tightness while overlapping to the male mullion 23 at completion of frame installation. In a preferred embodiment, system 10 may also be furnished with edge covers or caps 40*a*, 40*b* and 40*c* at slab 15 where the system engages with the upper surface 15*a* or the lower surface 15*b*. Beauty caps or edge covers 40*a* and 40*b* may be fastened in the field (e.g. during installation of the system) to mullion 22*a* and runs back to the intermediate transom 21*b* so as to engage the concrete slab 15 along the lower surface 15*b*. This solution may be desirable as it may help to eliminate the continuous caulking necessary for other prior art curtainwall system with cost saving reducing and simplifying the installation phase. The edge cover 40*c* engaging with the bottom or lower surface 15*b* of concrete slab 15 is easily snapped-in to the transom 22*a* of the frame 20 at the end of the installation sequence with savings in time and costs.

Figure 2C:
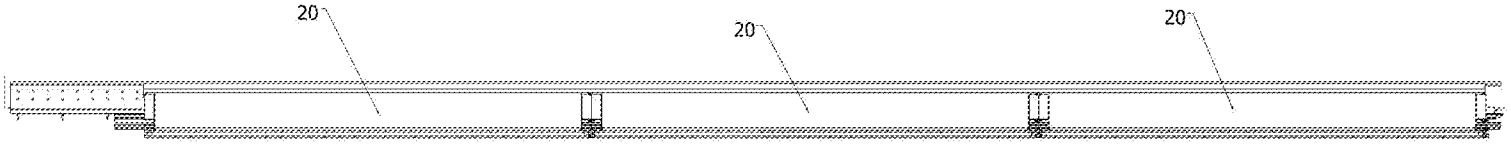

Although this disclosure has described and illustrated certain preferred embodiments. As shown in FIG. 2, it may be to be understood that the invention may be not restricted to those particular embodiments. Rather, the invention includes all embodiments which are functional or mechanical equivalence of the specific embodiments and features that have been described and illustrated.

I claim:

1. An interlocking unitized curtainwall building façade frame that is vertically and horizontally adjustable, the frame comprising:

upper and lower transom members and first and second mullions connected to the upper and lower transom members to form a frame body, the upper transom member releaseably engagable with an anchor member spanning the width of the upper transom affixed to a concrete slab, the anchor member having a general L shape with each arm of the L having a number of pre-punched anchor holes aligned or staggered in relation to each other for attaching to the concrete slab and for attaching to the upper transom, wherein the upper transom member is comprised of a first and second horizontal member, the first horizontal member releasably engagable with an upper surface of the concrete slab through the anchor member and the second horizontal member engaging with a lower surface of the slab to provide a seal between the frame and the concrete slab.

2. The frame of claim 1 wherein the anchor member has a generally horizontal arm portion and a generally vertical arm portion, whereby the generally horizontal arm portion is secured to the upper surface of the concrete slab and the generally vertical arm portion is affixed to the first horizontal member of the upper transom.

3. The frame of claim 2 wherein the horizontal and vertical arm portions of the anchor member are each provided with lip portions.

4. The frame of claim 3 wherein the generally vertical arm portion of the anchor member is secured to the upper transom with multiple fasteners provided in the anchor holes of the vertical arm portion.

5. The frame of claim 3 wherein the generally horizontal arm portion of the anchor member is secured to the upper surface of the concrete slab with multiple fasteners provided in the anchor holes of the horizontal arm portion.

6. The frame of claim 3 wherein the vertical arm portion has a shorter length than the horizontal arm portion.

7. The frame of claim 3 wherein the bottom transom engages with an upper transom of a second frame to provide a horizontal seal between the first and second frame and the first and second mullions engage with second and first mullions of a third and fourth frame to provide vertical seals, the second frame located below the frame and the third and fourth frames adjacent the frame.

8. The frame of claim 7 wherein insulation material is provided between the frame and the concrete slab.

9. The frame of claim 8 wherein the insulation material is insulation or fire stopping material.

10. The frame of claim 9 wherein the anchor member provides a smoke or sound barrier between the concrete slab and the frame.

11. An interlocking unitized curtainwall building façade system that is vertically and horizontally adjustable, the system comprising:

a first frame having upper and lower transom members and first and second mullions connected to the upper and lower transom members to form a first frame body, the upper transom member engaging a continuous first anchor member spanning the width of the upper transom affixed to a first concrete slab, the first anchor member having a general L shape with each arm of the L having a number of pre-punched anchor holes for attaching to the first concrete slab, wherein the continuous anchor of the first frame is secured to a top surface of the first concrete slab with concrete screws or nail-in pins, the anchor holes of the first anchor member aligned or staggered in relation to each other; and a second frame having upper and lower transom members and first and second mullions connected to the upper and lower transom members to form a second frame body, the upper transom member engaging a continuous second anchor member spanning the width of the upper transom affixed to a second concrete slab, the second anchor member having a general L shape with each arm of the L having a number of pre-punched anchor holes for attaching to the second concrete slab and engaging with the first frame, the anchor holes of the second anchor member aligned or staggered in relation to each other;

and wherein the bottom transom of the first frame engages with the upper transom of the second frame to provide a horizontal seal between the first and second frame, and wherein the upper transom of the first frame is comprised of a first and second horizontal member, the first horizontal member engaging an upper surface of the first concrete slab through the anchor member and the second horizontal member of the first frame engaging with a lower surface of first concrete slab to provide a seal.

12. The system of claim 11 wherein the first and second anchor member each have a generally horizontal arm portion and a generally vertical arm portion, whereby the generally horizontal arm portion is secured to the upper surface of the first and second concrete slab and the generally vertical arm portion is affixed to the upper transom member.

13. The system of claim 12 wherein the horizontal and vertical arm portions of the anchor member are each provided with lip portions.

14. The system of claim 13 wherein the anchor holes of the vertical arm portion of the first and second anchor are secured to the upper transom of the first and second frame with multiple fasteners.

15. The system of claim 14 wherein the bottom transom of the first frame engages with the upper transom of the second frame to provide a horizontal seal and the first and second mullions engage with second and first mullions of a third and fourth frame to provide vertical seals.

16. The system of claim 15 wherein insulation material is placed between each frame and each concrete slab.

17. The system of claim 16 wherein the insulation material is insulation or fire stopping material.

18. The system of claim 17 wherein each anchor member affixed to each frame provides a smoke or sound barrier between adjacent concrete slabs.

19. The system of claim 18 wherein frames of a curtain wall system are installed in a counter clockwise sequence and from the bottom up.

20. A method for installing an interlocking unitized curtainwall building façade system that is vertically and horizontally adjustable, the system comprising:

a first frame having upper and lower transom members and first and second mullions connected to the upper and lower transom members to form a first frame body, the upper transom member engaging a continuous anchor member spanning the width of the upper transom affixed to a first concrete slab, the anchor member having a general L shape with each arm of the L having a number of pre-punched anchor holes; and a second frame having upper and lower transom members and first and second mullions connected to the upper and lower transom members to form a second frame body, the upper transom member engaging a continuous second anchor member spanning the width of the upper transom affixed to a second concrete slab, adjacent the first anchor member; the second anchor member having a general L shape with each arm of the L having a number of pre-punched anchor holes; the method comprising:

attaching the first and second anchors to the first concrete slab adjacent each other;

releasably engaging the first vertical mullion of the first frame with the second vertical mullion of the second frame to provide a vertical seal between the first and second frame;

attaching the first and second frames to the first and second anchor; and leveling the first and second frames.

* * * * *